US010480106B2

(12) United States Patent
Krajewski et al.

(10) Patent No.: US 10,480,106 B2
(45) Date of Patent: Nov. 19, 2019

(54) ELECTRICALLY CONDUCTIVE TEXTILE

(71) Applicant: Commonwealth Scientific and Industrial Research Organisation, Acton, Australian Capital Territory (AU)

(72) Inventors: Andrzej Stanislaw Krajewski, Belmont (AU); Laurence Michael Staynes, Highton (AU); Ilias Louis Kyratzis, Brighton (AU); Douglas James Dower, Ocean Grove (AU); Peter Ralph Herwig, Hamlyn Heights (AU)

(73) Assignee: Commonwealth Scientific and Industrial Research Organisation (AU)

( * ) Notice: Subject to any disclaimer, the term of this patent is extended or adjusted under 35 U.S.C. 154(b) by 23 days.

(21) Appl. No.: 15/539,537

(22) PCT Filed: Dec. 18, 2015

(86) PCT No.: PCT/AU2015/050815

§ 371 (c)(1),
(2) Date: Jun. 23, 2017

(87) PCT Pub. No.: WO2016/101022

PCT Pub. Date: Jun. 30, 2016

(65) Prior Publication Data

US 2017/0362747 A1 Dec. 21, 2017

(30) Foreign Application Priority Data

Dec. 24, 2014 (AU) ..... 2014905262

(51) Int. Cl.
*D03D 1/00* (2006.01)
*D03D 15/00* (2006.01)
(Continued)

(52) U.S. Cl.
CPC ..... *D03D 1/0088* (2013.01); *A41D 1/002* (2013.01); *D03D 1/0058* (2013.01); *D03D 15/00* (2013.01);
(Continued)

(58) Field of Classification Search
CPC ..... D03D 1/0088
(Continued)

(56) References Cited

U.S. PATENT DOCUMENTS 6,727,197 B1 4/2004 Wilson et al.
7,022,917 B2 4/2006 Jung et al.
(Continued)

FOREIGN PATENT DOCUMENTS

WO 2005/005698 A1 1/2005

OTHER PUBLICATIONS

International Search Report and Written Opinion of the International Searching Authority for corresponding International Patent Application No. PCT/AU2015/050815 dated Feb. 23, 2016, 15 pages.

*Primary Examiner* — Brent T O'Hern
(74) *Attorney, Agent, or Firm* — Merchant & Gould P.C.

(57) ABSTRACT

Embodiments relate to conductive textiles and methods of their production, as well as systems for electronically connecting devices through conductive textiles. An example textile comprises a first electrically conductive track; a second electrically conductive track; and at least one non-conductive portion. At least a portion of the first electrically conductive track overlaps or is in close proximity to at least a portion of the second electrically conductive track. At least said portions of the respective tracks are separated by an insulating material so that there is no electrical coupling between the first and second tracks.

13 Claims, 6 Drawing Sheets

(51) Int. Cl.

| | |
|---|---|
| ***A41D 1/00*** | (2018.01) |
| ***D03D 41/00*** | (2006.01) |
| ***H01B 7/282*** | (2006.01) |

(52) U.S. Cl.
CPC ..... *D03D 15/0022* (2013.01); *D03D 15/0066* (2013.01); *D03D 41/00* (2013.01); *H01B 7/282* (2013.01); *A41D 2500/20* (2013.01); *D10B 2101/20* (2013.01); *D10B 2401/16* (2013.01); *D10B 2401/18* (2013.01)

(58) Field of Classification Search
USPC ..... 428/114
See application file for complete search history.

(56) References Cited

U.S. PATENT DOCUMENTS

| | | | | |
|---|---|---|---|---|
| 7,329,323 | B2 | 2/2008 | Dhawan et al. | |
| 2012/0030935 | A1* | 2/2012 | Slade ..... | H01R 12/61 29/825 |

* cited by examiner

ELECTRICALLY CONDUCTIVE TEXTILE

CROSS-REFERENCE TO RELATED APPLICATIONS

This application is a National Stage Application of PCT/AU2015/050815 filed on 18 Dec. 2015, which claims priority from Australian Provisional Patent Application No 2014905262 filed on 24 Dec. 2014, and which applications are incorporated herein by reference. To the extent appropriate, a claim of priority is made to each of the above disclosed applications.

TECHNICAL FIELD

Described embodiments relate to conductive textiles and methods of their production, as well as systems for electronically connecting devices through conductive textiles.

BACKGROUND

Many professions require workers to wear or carry multiple pieces of equipment on their person during the day. For example, workers may be required to carry radios, pagers, mobile telephones and head-sets. Emergency workers may also have various kinds of sensing equipment, which may each require different power sources. In some cases, various devices worn by the person may need to communicate with each other.

Previously, this may have been done by connecting the devices and power supplies together using cables. However, cables can be constricting, messy, and can become unplugged. Previous attempts at using conductive textiles to connect devices has failed due to the properties of the textiles used.

It is desired to address or ameliorate one or more shortcomings or disadvantages associated with conductive textiles and methods of producing them, as well as systems for electronically connecting devices through conductive textiles, or to at least provide a useful alternative thereto.

Any discussion of documents, acts, materials, devices, articles or the like which has been included in the present specification is not to be taken as an admission that any or all of these matters form part of the prior art base or were common general knowledge in the field relevant to the present disclosure as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

SUMMARY

A textile is provided comprising:
- a first electrically conductive track;
- a second electrically conductive track; and
- at least one non-conductive portion;
- wherein at least a portion of the first electrically conductive track overlaps or is in close proximity to at least a portion of the second electrically conductive track;
- wherein at least said portions of the respective tracks are separated by an insulating material so that there is no electrical coupling between the first and second tracks;

- wherein each track comprises a bundle of conductive filaments;
- wherein each conductive filament is less than 140 microns thick; and
- wherein each bundle comprises at least 100 conductive filaments.

A further textile is provided comprising:
- at least two electrically conductive tracks; and
- at least one non-conductive portion;
- wherein the at least two electrically conductive tracks are separated from each other by the non-conductive portion;
- wherein each track comprises a bundle of conductive filaments;
- wherein each conductive filament is less than 140 microns thick; and
- wherein each bundle comprises at least 100 conductive filaments.

A further textile is provided comprising:
- a first electrically conductive track;
- a second electrically conductive track; and
- at least one non-conductive portion;
- wherein at least a portion of the first electrically conductive track overlaps or is in close proximity to at least a portion of the second electrically conductive track; and
- wherein at least said portions of the respective tracks are separated by an insulating material so that there is no electrical coupling between the first and second tracks.

In various embodiments, the first track may overlap or be in close proximity to the second track at an angle of between 45° and 135°, at an angle of between 70° and 110° or at an angle of around 90°.

In any embodiments, the insulating material may be dissolvable by heat or by way of a chemical substance to provide electrical coupling between said portions of the first and second tracks, without dissolving the non-conductive portion.

In any embodiments, each track may comprise a bundle of conductive filaments.

In some embodiments, the conductive filaments in each bundle of conductive filaments are joined by being twisted together. Each bundle of conductive filaments may be twisted together up to 300 times per meter. Each bundle of conductive filaments may be twisted together 50, 100, 150, 200, 250 or 300 times per meter.

A further textile is provided comprising:
- at least two electrically conductive tracks; and
  - at least one non-conductive portion;
  - wherein the at least two electrically conductive tracks are separated from each other by the non-conductive portion; and
- wherein each track comprises a bundle of conductive filaments.

With respect to either textile, each of the electrically conductive tracks may comprise between one and twenty bundles of conductive filaments.

With respect to either textile, the textile in certain embodiments may comprise at least three electrically conductive tracks, wherein the tracks comprise at least a signal track, a power in track, and a power out track. The signal track may be configured to be able to transmit digital and/or analogue data signals. The signal track may be configured to be able to transmit data at a speed of between 100 MHz and 1000 MHz, or at a speed of about 400 MHz. The signal track, power in track and power out track may be electrically coupled to a connector.

In certain embodiments with respect to either textile, each bundle may comprise at least 100 filaments. In some embodiments, each bundle may comprise between 100 and 1000 conductive filaments, between 200 and 600 conductive filaments, or between around 400 conductive filaments.

In certain embodiments with respect to either textile, each conductive filament may be between 10 and 140 microns thick, between 20 and 120 microns thick or 40 microns thick. In some embodiments, each conductive filament may be less than 140 microns thick, or less than 120 microns thick.

In certain embodiments with respect to either textile, each conductive filament may comprise a silver coated copper.

A layered textile is provided comprising:

a first layer comprising one of the previously described textiles or one of its respective embodiments; and second and third layers comprising an electromagnetically shielding material; wherein the first layer is between the second and third layers.

The layered textile may further comprise fourth and fifth layers comprising a waterproof material, wherein the first, second and third layers are between the fourth and fifth layers.

A method of manufacturing a conductive textile is provided, the method comprising:

arranging a selection of conductive warp fibres and non-conductive warp fibres on a loom;

weaving a selection of conductive weft fibres and non-conductive fibres weft fibres through the warp fibres to produce a textile; and coating the conductive warp fibres and the conductive weft fibres in an insulating material so that there is no electrical connection between overlapping conductive fibres.

The method may further comprise selectively creating joins between the conductive warp fibres and the conductive weft fibres, to form an electrical connection at the join. In some embodiments, the step of selectively creating joins comprises dissolving the insulating material from the conductive warp fibres and the conductive weft fibres at a location where a join is desired.

In some embodiments of the method, the step of selectively creating joins may comprise soldering the conductive warp fibres and the conductive weft fibres at a location where a join is desired.

In some embodiments of the method may further comprise selectively breaking at least one of the conductive warp fibres and the conductive weft fibres at a location between which an electrical connection is not desired.

In some embodiments of the method may further comprise attaching a electromagnetically shielding material to each side of the textile.

In some embodiments of the method may further comprise attaching a waterproof material to each side of the textile.

BRIEF DESCRIPTION OF THE DRAWINGS

In order that the present invention may be more clearly ascertained, embodiments will now be described, by way of example, with reference to the accompanying drawings, in which.

DETAILED DESCRIPTION

Described embodiments generally relate to conductive textiles and methods of producing them, as well as systems for electronically connecting devices through conductive textiles.

Electrically conductive textiles allow for the integration of electrical cabling and connections into clothing and apparel in an unobtrusive manner. Electronic devices can be integrated into garments by separating the working electronic components, such as the battery, keyboard and screen, and distributing them on the wearer's body in order to improve the efficiency, comfort and convenience associated with using these devices. Conductive textiles can also be used to connect multiple devices together to allow them to communicate. For example, in military or rescue service apparel, a conductive textile may be used to provide for communication between personal digital assistants (PDAs), digital role radios, a central battery, energy storage devices, energy harvesting devices and power management systems. The textiles may be used to conduct an electrical data signal for communication purposes and to supply power to devices.

Figure 1:
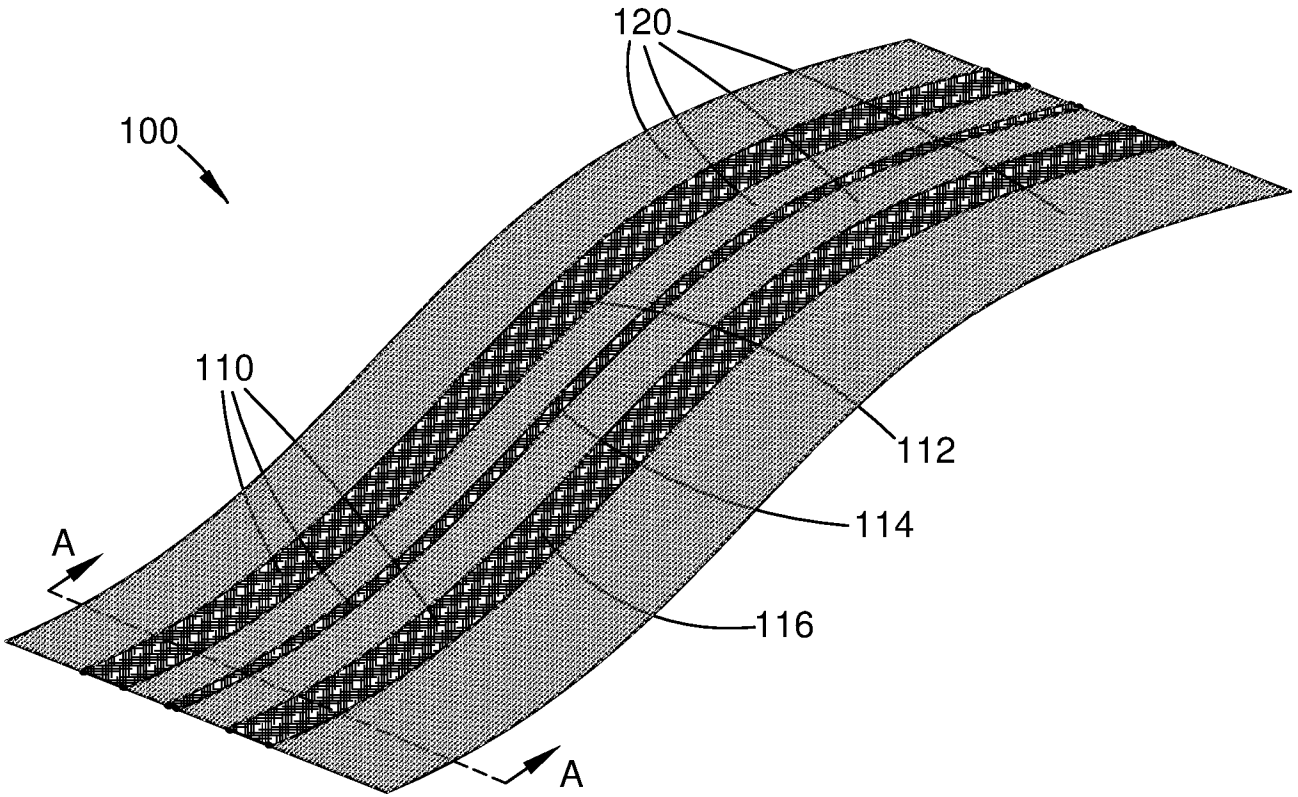
FIG. 1 is a perspective view of a textile with conductive tracks.

FIG. 1 shows a conductive textile 100. Textile 100 is formed from a base fabric 120 which may be a flexible and strong fabric suitable for wearing as clothing. In some embodiments, fabric 120 may be a non-conductive or electrically insulating fabric. In some embodiments, base fabric 120 may be nylon, polyester, polyethylene, wool, cotton or another suitable fabric. If desired, the fabric may be waterproof, heat-insulating, and/or washable, depending on the application. Furthermore, the fabric may be selected in order that tracks woven into in can be soldered without the fabric melting or becoming damaged. For example, a flame or heat resistant fabric, such as Nomex™, may be selected. The fabric may be 2 folded in some embodiments, and may be a 1/40 cotton, or have a linear density of twice R2/30 tex (equivalent to R4/60 tex). The fabric may have a thread count of around 19 ends/cm in the warp and 12 picks/cm in the weft, in some embodiments. In other embodiments, there may be between 5 and 30 ends or picks per cm.

Textile 100 further includes conductive tracks 110 woven through base fabric 120. Tracks 110 may allow for the transmission of power and data. Textile 100 may have multiple tracks spaced along its width. In some embodiments, the tracks may be grouped in sets of three tracks; a power in track 112, a power out track 116, and a signal track 114. When two devices are connected by respective tracks 110, they may send communication signals along the signal track 114. Power in and power out tracks 112 and 116 may be used to supply power from a first device or power supply to a second device. In the illustrated embodiment, tracks 110 run longitudinally or along the "warp" of the textile, although the tracks may be woven to run latitudinally or along the "weft" of the textile in alternative embodiments. It should also be appreciated that the respective tracks can be in a different order to that illustrated in FIG. 1.

In some embodiments, tracks 110 may allow for high speed data to be transmitted. Data may include analogue and digital data signals, such as video and audio signals, for example. In some embodiments, tracks 110 may allow for data to be transmitted at speeds corresponding to the Universal Serial Bus 3 (USB 3) specifications. In some embodiments, data may be capable of being transmitted between 100 MHz and 1000 MHz, for example. In some embodiments, data may be capable of being transmitted at up to 100 MHz, 200 MHz, 300 MHz, 400 MHz, 500 MHz, 600 MHz, 700 MHz, 800 MHz, 900 MHz, or 1000 MHz.

Figure 2A:
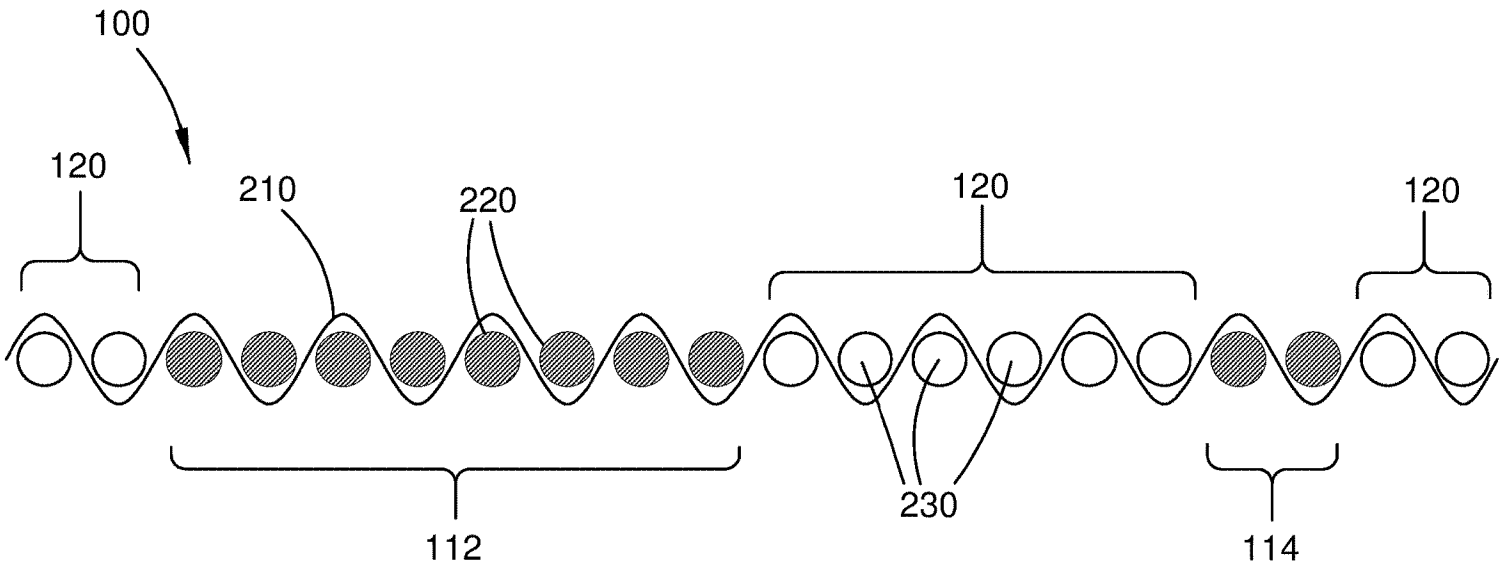
FIG. 2*a* is a sectional view of the textile of FIG. 1 along line A-A.

FIG. 2*a* shows a cross-section of textile 100. Each track 112, 114 may be formed of a plurality of conductive fibre bundles 220 with each bundle acting as a thread within textile 100. In some embodiments, power in track 112 and power out track 116 (not shown) may each contain eight fibre bundles 220, and signal track 114 may be formed of two fibre bundles 220. In some other embodiments, power in track 112 and power out track 116 may each contain between one and twenty fibre bundles 220, and preferably between six and fourteen fibre bundles 220. In some embodiments, signal track 114 may contain between one and twenty fibre bundles 220, and preferably between one and five fibre bundles 220. It should be appreciated that the preferred number is dependent on the fibre diameters.

In the illustrated embodiment, track 112 is shown as being made up of eight fibre bundles 220, and track 114 is shown as being made up of two fibre bundles 220. The number of bundles 220 to be used can be selected depending on the current that is to be drawn through them, and the maximum heating of the tracks that is desired.

Table 1 below provides some temperatures that tracks 110 may heat up to depending on the number of fibre bundles 220 that are used, over different time periods. The data in the table is based on 200 mm strands of 0.040 mm silver coated copper wire, with a current of 5 Amperes running through them. As seen in the table, the temperature of tracks 110 decreases when more bundles 220 are used. The temperature of tracks 110 may be particularly important in a case where a low infrared signature is desired.

TABLE 1

| | t | 14 bundles | 16 bundles | 18 bundles | 20 bundles | 22 bundles |
|---|---|---|---|---|---|---|
| Temp of tracks in ° C. after passing current for a duration t: | 2 mins | 39.1 | 37.1 | 34 | 31.8 | 27.1 |
| | 5 mins | 42.9 | 39.9 | 36.1 | 33.6 | 29.2 |
| | 10 mins | 43.8 | 41.1 | 37.8 | 34.7 | 30.7 |
| Average temp dissipated across track surface | 10 mins | 32.9 | 30.5 | 29.1 | 27.5 | 26.7 |

Tracks 110 are separated by base warp fibres 230. Warp fibres 230 and fibre bundles 220 are woven together with base weft fibres 210. As seen in FIG. 2*a*, warp fibres 230 weave in and out of weft fibres 230 in an alternating pattern, with adjacent warp fibres 230 weaving in opposite directions, as in a standard woven textile. Areas where the base warp fibre 230 and base weft fibres 210 intersect make up the base fabric 120.

Textile 100 may be woven on a weaving machine such as a Rapier CCI weaving machine. The width of textile 100 may be between 30 cm and 100 cm, such as 45 cm in some embodiments. The weave design may be a plain weave. Alternatively, it may be a twill or satin weave in some embodiments.

Figure 2B:
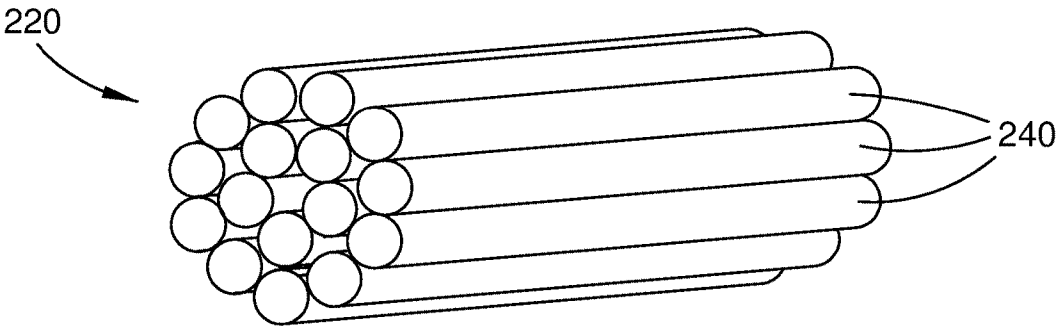
FIG. 2*b* is a perspective view of a fibre bundle used in the textile of FIG. 1.

FIG. 2*b* shows a fibre bundle 220 in more detail. Each fibre bundle 220 is made up of a plurality of individual conductive filaments 240. Each filament 240 is made of a conductive material, such as copper, silver, or gold, or a metal coated polyester, nylon or Kevlar™ thread. The material chosen may be varied depending on the conductivity, strength and flexibility desired of textile 100. For example, if using a silver coated nylon, polyester or Kevlar™, these materials may be prone to melting or otherwise failing at high currents. In some embodiments, each filament 240 may be made of silver-coated copper wire, which may perform better under high current than a silver coated nylon, polyester or Kevlar™. For example, for a set thickness of 0.040 mm and length of 200 mm, a silver coated nylon may melt at around 1.8 Amperes, a silver coated polyester may melt at around 3.1 Amperes, and a silver coated Kevlar™ may fail at around 4.9 Amperes, while a silver coated copper may work with a current up to and over 5 Amperes.

Each filament 240 may be very small, in the order of 40 microns thick. In some embodiments, each filament 240 may be less than 140 microns thick, and preferably less than 120 microns thick. In some embodiments, each filament 240 may be between 10 and 140 microns thick, and preferably between 20 and 120 microns thick. Each fibre bundle 220 may contain hundreds of filaments 240. For example, in some embodiments each fibre bundle 220 may contain around 400 filaments 240. In some embodiments, each fibre bundle 220 may contain at least 100 filaments 240. In some embodiments, each fibre bundle 220 may contain between 100 and 1000 filaments 240, and preferably between 200 and 600 filaments 240. Having a bundle of many thin fibres allows for a high conductivity to be achieved while still allowing the resulting textile to be flexible. For a single wire to be equally conductive would require that it was relatively thick, making it less flexible.

The thickness of filaments 240 and the number of filaments 240 may be adjusted to vary the conductivity and flexibility of textile 100. For example, if a highly flexible textile is desired, filaments 240 may be made thinner, and each fibre bundle 220 may contain a smaller number of filaments 240. Alternatively, if a higher conductivity is desired, a larger number of filaments 240 may be used in each fibre bundle 220, and/or each filament 240 may be made thicker. To further increase conductivity, a higher number of fibre bundles 210 may be used in each track 110.

Where a high current is to be used, a high conductivity may be desired to avoid tracks 110 heating up beyond a reasonable amount. For example, in some embodiments tracks 110 may be designed to heat up a maximum of 2.5° C. above ambient temperature with a maximum current of 7 Amperes. A textile 100 with these desired characteristics may be designed with each track 110 being made up of eight fibre bundles 220, and each bundle 220 being made up of 400 filaments 240, each filament being 40 microns thick, for example. Each fibre bundle 220 may be coated in an insulating material, such as a polyester, polyimide or silicone coating, before being woven into textile 100. Alternatively, a coating may be applied to the tracks or the entire surface of textile 100 after it has been manufactured.

Figure 3:
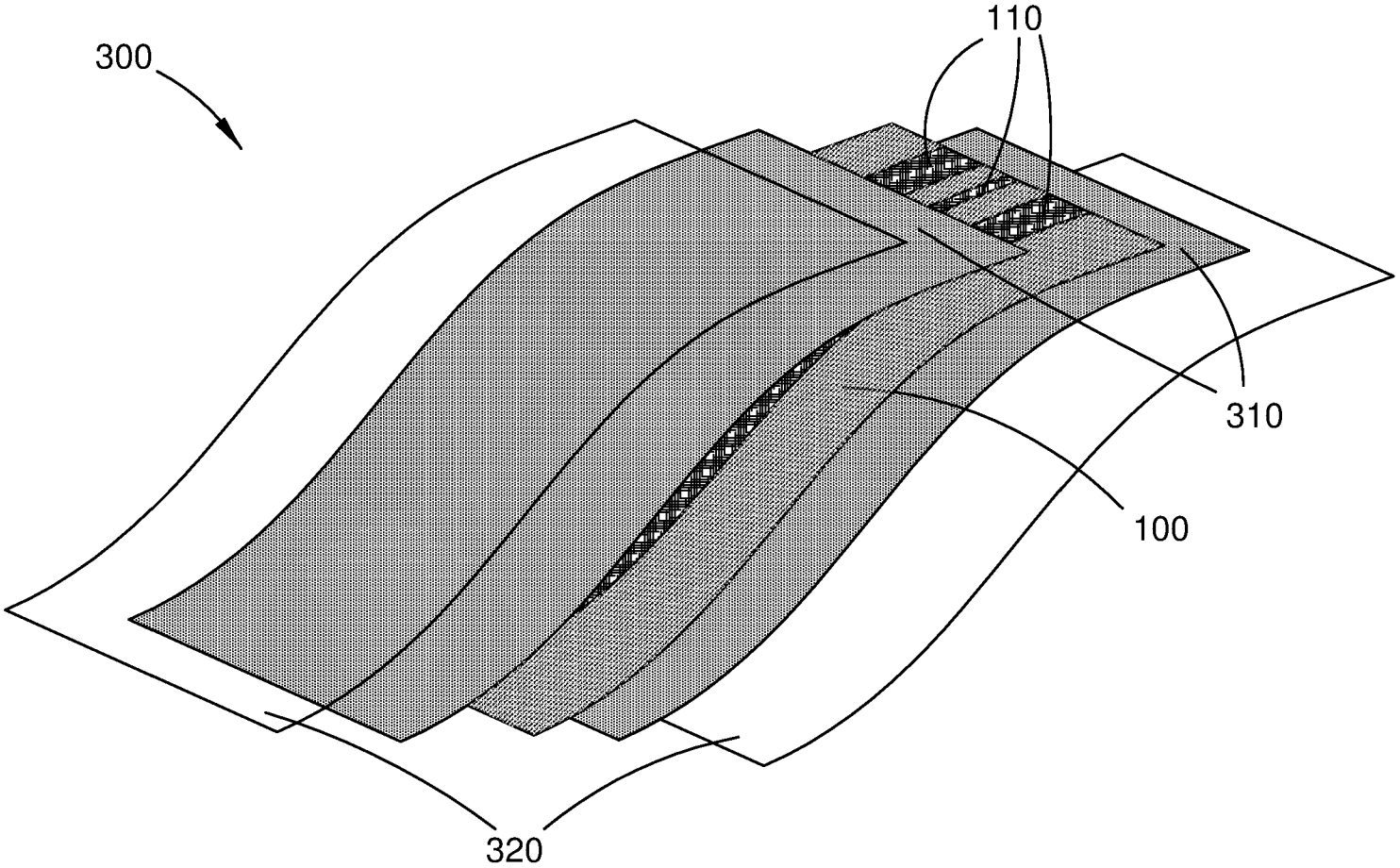
FIG. 3 is an exploded view of a layered textile including the textile of FIG. 1.

FIG. 3 shows a layered textile 300. Textile 300 may be made up of protective layers 320 surrounding shielding layers 310, with shielding layers 310 surrounding the conductive textile 100. Shielding layers 310 may be woven or knit conductive textiles, which may be constructed of a conductive fibre such as copper, silver, or gold, or a metal coated polyester, nylon or Kevlar™ thread. In some embodiments, shielding layers 310 may be knitted or woven from a silver coated polyester, or a silver coated nylon, such as a 2-ply Shieldex™ conductive yarn with a linear density of the 117/17 dtex, for example. The particular weave or knit used can affect the range of frequencies that shielding layers 310 provide protection, as well as the extent of shielding provided. A textile woven in a plain weave design with a thread count of 23 ends/cm on the warp and 15.7 picks/cm on the weft may provide protection from frequencies between 30 and 120 MHz, and may reduce the signal strength of the interference signals by around 15 dB. These values may vary when a different weave design or a different thread count is used.

Table 2 below shows some examples of how changing the property of a knit fabric can change the resulting shielding effect of the fabric.

TABLE 2

| Gauge scale graduation in Cotton Fully-fashioned machine classification | Loop width | Loop length | Frequency range shielded | Shield strength |
|---|---|---|---|---|
| 20 gg | 0.90 mm | 5.03 mm | 30-134 MHz | 10-20 dB |
| 20 gg | 1.00 mm | 4.53 mm | 56-112 MHz | 10-20 dB |
| 20 gg | 1.10 mm | 4.12 mm | 49-140 MHz | 10-20 dB |
| 24 gg | 1.20 mm | 3.77 mm | 30-56 MHz | 12-23 dB |
| 24 gg | 1.37 mm | 3.31 mm | 30-140 MHz | 14-26 dB |

Shielding layers 310 may be knitted by machine, using a knitting machine such as a Shima™ knitting machine. Alternatively, shielding layers 310 may be woven on a weaving machine such as a Rapier CCI weaving machine. Shielding layers may be woven at a width of between 30 cm and 100 cm, such as a width of 45 cm, for example.

Shielding layers 310 may provide a Faraday cage around textile 100 in order to protect textile 100 from electromagnetic and electrical interference. Shielding layers 310 may be stitched, glued, or attached by other means to textile 100. Shielding layers 310 may cover only tracks 110 of fabric 100, or may be used to cover the entire surface of textile 100. Protective layers 320 may be made of an insulating and waterproof material, such as SELLEYS™ brush-able water barrier, or any other flexible or rigid protective coating being made of a polymer or other material. Protective layers 320 may protect layers 310 and textile 100 from moisture, abrasion, and other environmental factors.

Figure 4:
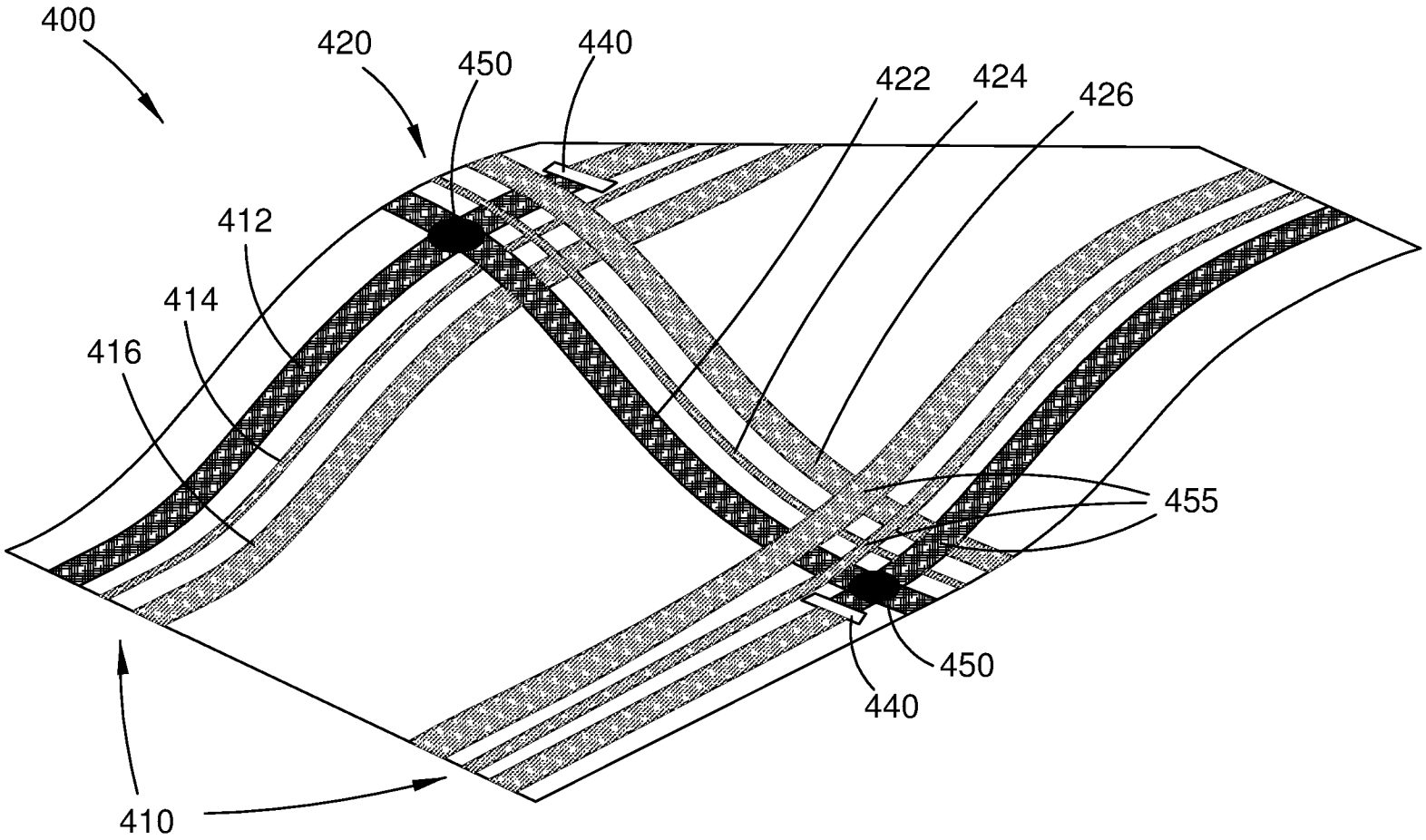
FIG. 4 is a perspective view of a textile with multidirectional conductive tracks.

FIG. 4 shows a conductive textile 400 having both conductive warp tracks 410 and conductive weft tracks 420. In the illustrated embodiment, tracks 410 and 420 run perpendicular to one another. However, in some embodiments tracks 410 and 420 may be configured to be at any angle to one another. The angle may be between 45° and 135°, for example, and may preferably be between 70° and 110°. Having a grid of tracks allows for a conductive path to be created between selected areas of textile 400 by selectively connecting tracks 410 and 420 and by cutting the tracks where a connection is not desired.

Tracks 410 and 420 may include power in tracks 412 and 422, power out tracks 416 and 426, and signal tracks 414 and 424. As in textile 100, each track 410 and 420 may be constructed of a plurality of fibre bundles 220, which may each be made up of a large number of filaments 240. Tracks 410 and 420 may be woven into a base fabric.

As tracks 410 and 420 are disposed at an angle to one another, the tracks overlap at junctions 455. As each fibre bundle 220 is insulated, tracks 410 and 420 can overlap at junctions 455 without forming an electrical connection. If a connection between the tracks in desired, fibre bundles 220 may be coated in a meltable or dissolvable insulating layer. In order to produce a connection, heat or solvent can be applied to a junction 455 in order to remove the insulating coating from each fibre bundle 220. The tracks 410 and 420 can then be soldered together to form a connection 450. If desired, an insulating coating can then be applied to textile 100 in the area of connection 450 in order to insulate the join.

Where a connection between two points is not desired, tracks 410 and 420 may be cut to form a cut track 440. This may be done by using a knife or blade to break, cut, or remove a portion of track 410 or 420, in order that there is no longer an electrical connection between the parts of the track on either side of the cut 440. The separation may also be achieved by chemically or physically removing the conductive compound from the metal coated yarn.

Figure 5:
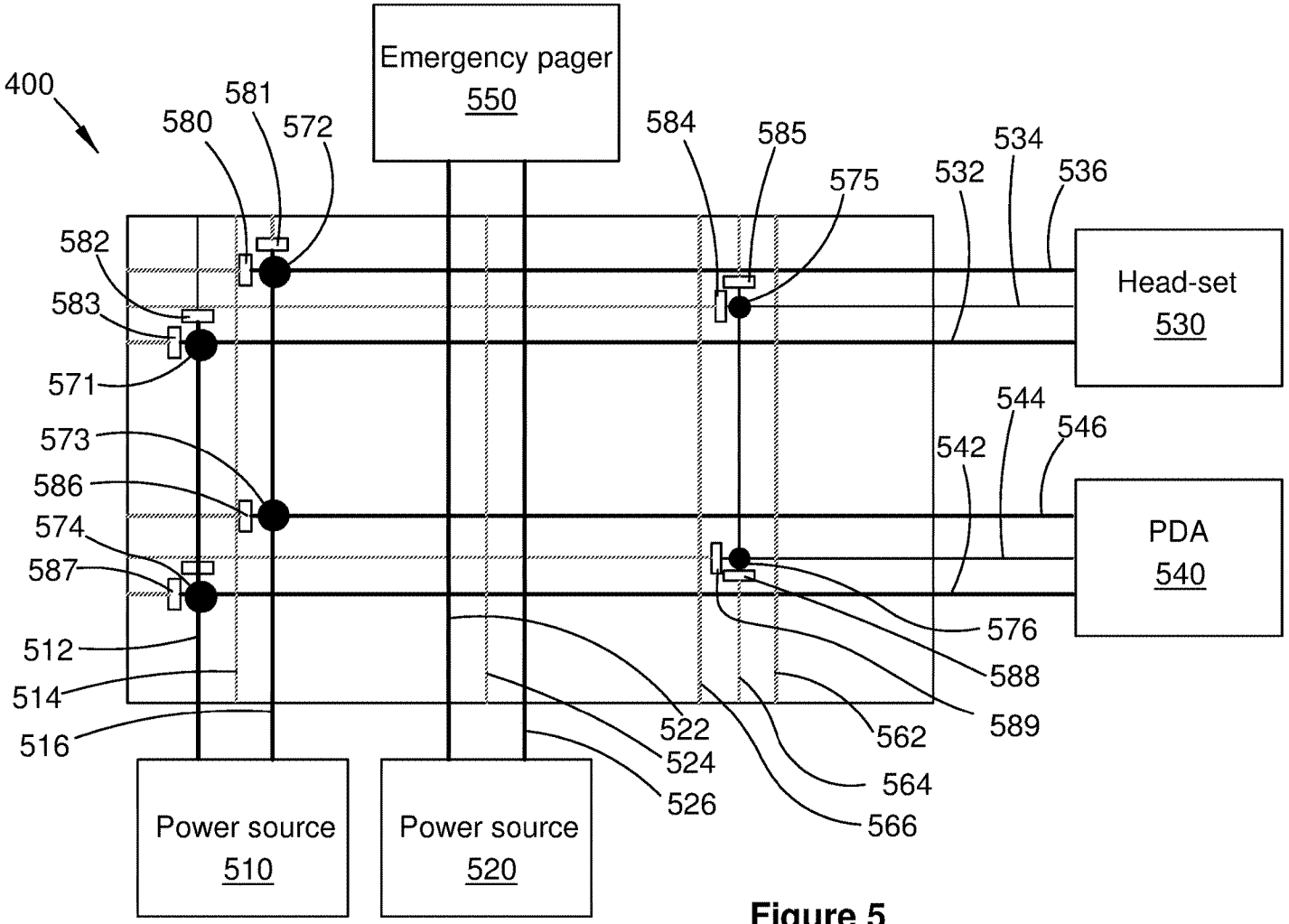
FIG. 5 is a top view of the textile of FIG. 4 connecting multiple devices.

FIG. 5 shows textile 400 connecting a number of devices and power supplies. In the illustrated embodiment, power source 510 is connected through textile 400 to supply power a head-set 530 and a PDA 540. Head-set 530 is also connected through textile 400 to communicate with PDA 540. A separate power source 520 is connected to supply power to an emergency pager 550. However, it is envisioned that head-set 530, PDA 540 and emergency pager 550 may be replaced by any device that can transmit and/or receive data by either digital or analogue means, and may include passive elements like sensors or active elements such as USB or other serial communication transmitters and receivers, and may be used to send and receive digital or analogue audio, video or other signals.

Power source 510 is connected to power in track 512 and power out track 516 of textile 400. Signal track 514 is not connected to any devices. Power in track 512 is connected at connection 574 to power in track 542, and power out track 516 is connected at connection 573 to power out track 546. Power in track 542 and power out track 546 connect to PDA 540 in order to supply power to PDA 540. Power in track 542 and power out track 546 are separated to the left of connections 574 and 573 to electrically separate tracks 542 and 546, forming cut tracks 587 and 586. This ensures that tracks 542 and 546 does not connect power source 510 to sections of textile 400 that do not lead to a device that requires power. Although only a section of textile 400 is shown in FIG. 5, cutting the tracks may be particularly important in a large textile where multiple devices may need to be connected, in order to provide separation between the conductive sections.

Power in track 512 is also connected at connection 571 to power in track 532, and power out track 516 is also connected at connection 572 to power out track 536. Power in track 532 and power out track 536 connect to head-set 530 in order to supply power to head-set 530. Power in track 542 and power out track 546 are broken to the left of connections 571 and 572 to form cut tracks 583 and 580. This ensures that tracks 532 and 536 does not connect power source 510 to sections of textile 400 that do not lead to a device that requires power. Power in track 512 and power out track 516 are also broken above connections 571 and 572 to form cut tracks 582 and 581. This ensures that tracks 512 and 516 does not connect power source 510 to sections of textile 400 that do not lead to a device that requires power.

Head-set 530 is connected to signal track 534 of textile 400. Signal track 534 is connected at connection 575 to signal track 564. Signal track 534 is broken to the left of connection 575 to form cut track 584, and signal track 564 is broken above connection 575 to form cut track 585. Signal track 564 is then connected at connection 576 to signal track 544. Signal track 534 is broken to the left of connection 576 to form cut track 589, and signal track 564 is broken below connection 576 to form cut track 588. Signal track 544 connects to PDA 540. Tracks 534, 564 and 544 provide a signal connection between head-set 530 and PDA 540 to allow communication between the devices. For example, PDA 540 may send audio data to head-set 530, which may allow a user to hear the audio through head-set 530. Power in track 562 and power out track 566 are not connected to any devices.

Power source 520 is a separate power source connected to emergency pager 550 through power in track 522 and power out track 526. This may be so that the emergency pager 550 is still able to be used if power source 510 is depleted or faulty. Signal track 524 is not connected to any devices.

Figure 6:
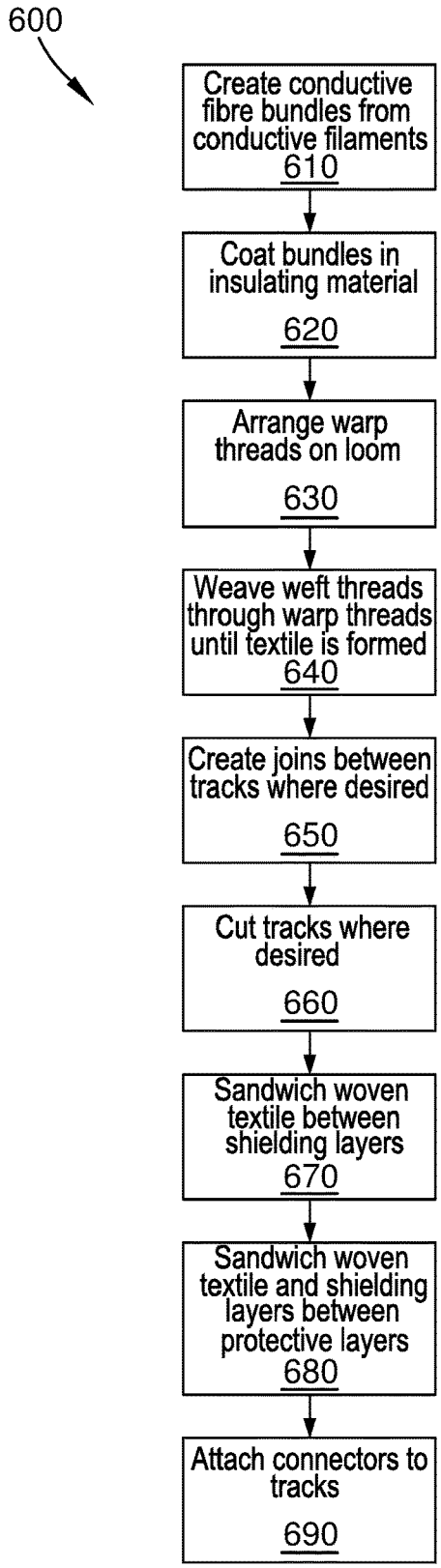
FIG. 6 is a flowchart of a method for making a textile with conductive tracks.

FIG. 6 is a flowchart of a process for creating conductive textile 100 or 400, or layered textile 300. At step 610, one or more fibre bundles 220 is created by joining conductive filaments 240 together. Filaments 240 may be joined by being twisted together. In some embodiments, filaments 240 may be twisted together up to 300 times per meter. In some embodiments, filaments 240 may be twisted together 50, 100, 150, 200, 250 or 300 times per meter. Alternatively, filaments 240 may run in parallel. In some embodiments, filaments 240 may be joined by a glue or other binding material. Once the bundles 220 are formed, at 620 they are coated in an insulating material.

Once bundles 220 are constructed and insulated, warp threads are arranged on a loom at step 630. In some embodiments, the warp threads may include conductive fibre bundles 220, as well as base warp fibres 230. In embodiments where conductive fibre bundles 220 run only latitudinally along the weft of the textile, the warp threads may be only base warp threads 230.

Once the warp fibres are arranged, weft fibres are woven through the warp fibres to produce a textile at step 640. If the warp fibres included fibre bundles 220, the weft fibres may be only base weft fibres 210, in order to produce textile 100. Alternatively, the weft fibres may include both base weft fibres 210 and fibre bundles 220 in order to create a textile such as textile 400, in which conductive tracks 410 and 420 run in perpendicular directions.

If a textile with overlapping tracks, such as textile 400, is created, at step 650 joins may be created between the overlapping tracks. This may be done by dissolving the insulating material around each fibre bundle 220, and soldering the tracks together. It may further include adding an insulating material to protect the join once it has been created.

At 660, tracks 110/410/420 may be cut where desired, in order to prevent a connection between parts of the tracks where a connection is not required. This may be done by using a sharp or abrasive tool to physically remove a portion of the track.

At 670, shielding layers 310 may be added on either side of the textile 100/400. This may be done by gluing the layers, stitching them, or by another form of adhesion.

At 680, protective layers 320 may be added to either side of textile 100/400 on the outside of shielding layers 310. This may be done by gluing the layers, stitching them, or by another form of adhesion.

At 690, connectors may be added to textile 100/400 in order to facilitate connecting devices through the textile. Layers 310 and 320 may be cut away from portions of the tracks, and connectors (not shown may be soldered, crimped, glued, stitched or attached by any other means to tracks 110/410/420.

Textile 100/400 may then be formed into garment or a wearable strap, to be worn with devices such as power sources, phones, global positioning systems (GPSs), pagers, head-sets and other devices connected through tracks 110/410/420.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. A textile comprising:
- a first electrically conductive track;
- a second electrically conductive track; and
- at least one non-conductive portion;
- wherein at least a portion of the first electrically conductive track overlaps or is in proximity to at least a portion of the second electrically conductive track;
- wherein at least said portion of the first electrically conductive track and said portion of the second electrically conductive track are separated by an insulating material so that there is no electrical coupling between the first and second tracks;
- wherein each track comprises a bundle of conductive filaments;
- wherein each conductive filament is less than 140 microns thick; and
- wherein each bundle comprises at least 100 conductive filaments.

2. The textile of claim 1, wherein the first track overlaps or is in proximity to the second track at an angle of between 45° and 135°.

3. The textile of claim 1, wherein the insulating material is dissolvable by heat or a chemical substance to provide electrical coupling between said portions of the first and second tracks, without dissolving the non-conductive portion.

4. The textile of claim 1, wherein each of the first and second electrically conductive tracks comprises between one and twenty bundles of conductive filaments.

5. The textile of claim 1, comprising at least three electrically conductive tracks, wherein the tracks comprise at least a signal track, a power in track, and a power out track.

6. The textile of claim 5, wherein the signal track is configured to be able to transmit digital and/or analogue data signals.

7. The textile of claim 5, wherein the signal track is configured to be able to transmit data at a speed of between 100 MHz and 1000 MHz.

8. The textile of claim 5, wherein the signal track, the power in track and the power out track are electrically coupled to a connector.

9. A textile comprising:
- at least two electrically conductive tracks; and
- at least one non-conductive portion;
- wherein the at least two electrically conductive tracks are separated from each other by the at least one non-conductive portion;
- wherein each track comprises a bundle of conductive filaments;
- wherein each conductive filament is less than 140 microns thick; and wherein each bundle comprises at least 100 conductive filaments.

10. The textile of claim 9, wherein each bundle comprises between 100 and 1000 conductive filaments.

11. The textile of claim 9, wherein each conductive filament is between 10 and 140 microns thick.

12. A layered textile comprising:

a first layer comprising the textile of claim 1; and second and third layers comprising an electromagnetically shielding material;

wherein the first layer is between the second and third layers.

13. The layered textile of claim 12, further comprising fourth and fifth layers comprising a waterproof material, wherein the first, second and third layers are between the fourth and fifth layers.

* * * * *